US008167413B2

(12) United States Patent
Ito

(10) Patent No.: US 8,167,413 B2
(45) Date of Patent: May 1, 2012

(54) INKJET PRINTING APPARATUS AND METHOD FOR AGITATING INK

(75) Inventor: Akira Ito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 837 days.

(21) Appl. No.: 12/212,102

(22) Filed: Sep. 17, 2008

(65) Prior Publication Data

US 2009/0079802 A1 Mar. 26, 2009

(30) Foreign Application Priority Data

Sep. 21, 2007 (JP) ..... 2007-245367

(51) Int. Cl.
*B41J 2/175* (2006.01)

(52) U.S. Cl. ..... 347/85; 347/39; 347/92

(58) Field of Classification Search ..... 347/14, 347/19, 23, 27, 32, 37, 39, 70, 82, 84–86
See application file for complete search history.

(56) References Cited

U.S. PATENT DOCUMENTS

| | | | | |
|---|---|---|---|---|
| 6,695,441 | B2 | 2/2004 | Asano | |
| 6,951,382 | B2 | 10/2005 | Inui et al. | |
| 7,648,224 | B2 * | 1/2010 | Sasa et al. | 347/36 |
| 7,775,647 | B2 * | 8/2010 | Okito et al. | 347/86 |

FOREIGN PATENT DOCUMENTS

| | | | |
|---|---|---|---|
| JP | 2003-311993 | A | 11/2003 |
| JP | 2004-001411 | A | 1/2004 |

OTHER PUBLICATIONS

Office Action—Appln. No. 200810161806.3—The State Intellectual Property Office of P.R. China, May 10, 2010.

* cited by examiner

*Primary Examiner* — Thinh Nguyen
(74) *Attorney, Agent, or Firm* — Fitzpatrick, Cella, Harper & Scinto

(57) ABSTRACT

In order to recover unevenness in concentration of ink ejected from a print head, an agitation operation of agitating ink by causing the print head to reciprocate is carried out. This agitation operation sets a number of times of moving the print head for agitation according to a condition, such as a printing mode, for a reciprocating motion in a main scanning direction of the print head in printing.

10 Claims, 13 Drawing Sheets

| ACCELERATION DISTANCE(inch) \ ACCELERATED VELOCITY (inch/sec2) | <250 | 250~350 | 350< | 350< | 350< |
|---|---|---|---|---|---|
| <0.6 | 0.06 | 0.075 | 0.08 | 0.8 | 0.08 |
| 0.6~0.8 | 0.075 | 0.08 | 0.09 | 0.9 | 0.09 |
| 0.8~1.0 | 0.09 | 0.1 | 0.095 | 0.095 | 0.095 |
| 1.0< | 0.085 | 0.1 | 0.095 | 0.085 | 0.085 |
| | 1.0< | 0.085 | 0.095 | 0.095 | 0.085 |
| | | 1.0< | 0.85 | 0.095 | 0.085 |

FIG.4

$$Y = (Y_0 - \Sigma an)bc$$

Y: NUMBER OF RECIPROCATING MOTIONS IN AGITATION OPERATION

Y0: INITIAL VALUE OF NUMBER OF RECIPROCATING MOTIONS IN AGITATION OPERATION a: AGITATION CONVERSION PARAMETER n: NUMBER OF SCANNING MOVEMENTS b: INK REMAINING AMOUNT PARAMETER c: AGITATION INTERVAL PARAMETER

FIG.13

INKJET PRINTING APPARATUS AND METHOD FOR AGITATING INK

BACKGROUND OF THE INVENTION

1. Field of the Invention

The present invention relates to an inkjet printing apparatus that agitates ink in an ink reservoir and a method for agitating ink.

2. Description of the Related Art

Mainly dye inks and pigment inks are used for a printing apparatus performing printing by an inkjet method. Dye inks have high-color reproducibility, and have excellent characteristics such as gloss and high-quality color development. Further, dye inks are dissolved in solvents, which gives the advantage that disproportioned ink concentration does not easily occur. However, because color materials in dye inks are on the molecular level, dye inks are easily decomposed by light or an active gas, which results in a problem of lack of weather resistance.

Pigment inks have excellent resistance to weather as compared with dye inks because color materials diffuse in clumps in solutions. Pigment inks have had a reputation of being inferior in reproducibility and color developing compared to dye inks. However, the quality of pigment inks has been improved due to improvement of ink materials and the like in recent years, and pigment inks have come into greater use for photographic printing and the like in the same way as dye inks.

Pigment inks have a problem in that, because the color materials thereof diffuse in solutions, when the inks are left untouched for a long time, the color materials in the inks settle out, which results in a concentration difference generated in an ink tank. To prevent such a problem, a method to provide uniform ink concentrations so as to prevent a concentration difference has been proposed. U.S. Pat. No. 6,695,441 discloses a method for vibrating ink in an ink tank at a predetermined time with an ultrasonic transducer. Settling-out of the ink is suppressed and a concentration difference in the ink tank is suppressed by periodically vibrating the tank.

U.S. Pat. No. 6,951,382 discloses an inkjet printing apparatus in which ink in an ink tank is agitated by causing a print head to scan without ejecting the ink at predetermined times.

However, even if the ink in the tank is agitated at predetermined times by using a timer in the above-described method, there is a risk that the agitation is performed more than necessary, which wastes time for processes other than printing. For example, when printing is performed by the printing apparatus, even when the ink is sufficiently agitated by causing the print head to scan, there is a possibility that the ink may be agitated over the predetermined time immediately thereafter. In this case, there is a risk that the agitation is carried out for a long time regardless of the fact that the ink has already been sufficiently agitated by the print head scan. Such agitation is not really necessary, and results in too much wasteful agitation.

Further, agitation based on the timer is carried out when the printing apparatus is not performing printing. That is, while the ink in the ink tank is being agitated, it is impossible for a user to perform printing. While agitation is carried out, it is necessary for the user to wait for the completion of the agitation. Thus, the longer the time for the agitation, the lower the productivity of printed matters by the printing apparatus.

SUMMARY OF THE INVENTION

The present invention has been achieved in consideration of the above-described circumstances, and an object of the present invention is to reduce a time period and frequency of carrying out agitation and reduce the time when printing cannot be performed by performing agitation only when necessary.

According to a first aspect of the present invention, an inkjet printing apparatus includes a carriage capable of mounting a liquid container thereon and is configured to print on a printing medium by ejecting liquid supplied from the liquid container to a printing part in accordance with a reciprocating motion of the carriage. The inkjet printing apparatus comprises a control unit that carries out control for executing an agitation operation to agitate the liquid retained in the liquid container by moving the carriage; and, an agitation mode setting unit that sets an agitation condition for the agitation operation executed under control of the control unit.

The agitation mode setting unit sets the agitation condition for the agitation operation by the carriage in view of a printing mode for printing to the printing medium by the printing part.

According to a second aspect of the present invention, an inkjet printing apparatus includes a carriage capable of mounting a liquid container thereon, and performs printing on a printing medium by ejecting liquid supplied from the liquid container to a printing part in accordance with a reciprocating motion of the carriage. The inkjet printing apparatus comprises a control unit configured to control an agitation operation for agitating the liquid retained in the liquid container by moving the carriage; and, an agitation mode setting unit that sets a method for moving the carriage in the agitation operation under control of the control unit.

The agitation mode setting unit sets the method for moving the carriage that carries out the agitation operation in accordance with a predetermined agitation operation and a printing condition of the printing part.

According to a third aspect of the present invention, a method is provided for agitating ink in an inkjet printing apparatus. The apparatus includes a carriage capable of mounting an ink tank containing ink thereon, and performs printing on a printing medium by ejecting ink supplied from the ink tank to an ink ejecting part in accordance with a reciprocating motion of the carriage.

The inkjet printing apparatus includes a control unit configured to control an agitation operation of agitating ink retained in the ink tank by moving the carriage, and an agitation mode setting unit that sets an agitation condition for the agitation operation, the method comprises a step of reading an agitation conversion parameter on a printing mode by the ejecting part; a step of setting the agitation condition for the agitation operation by the carriage in view of the printing mode; and, a step of calculating a number of scanning movements of the carriage by the agitation operation on the basis of the respective parameters from an initial value of the number of reciprocating motions of the carriage in the agitation operation according to a parameter of the amount of ink remaining in the ink tank and an agitation interval parameter on a time interval among a plurality of agitation operations.

According to the inkjet printing apparatus and the method for agitating ink of the present invention, it is possible to shorten a time for an agitation operation by carrying out only a needed amount of agitation. Provided that a time in which printing cannot be performed due to agitation is shortened, a waiting time for a user is not unnecessarily lengthened.

Further features of the present invention will become apparent from the following description of exemplary embodiments (with reference to the attached drawings).

BRIEF DESCRIPTION OF THE DRAWINGS

FIG. 4 is a table used when an agitation conversion parameter is determined;

FIG. 13 is a formula for computation for calculating a number of reciprocating motions of the carriage at the time of an agitation operation.

DESCRIPTION OF THE EMBODIMENTS

Hereinafter, a first embodiment for implementing the present invention will be described with reference to the drawings.

(1) Description of the Configuration of the Printing Apparatus

Figure 1:
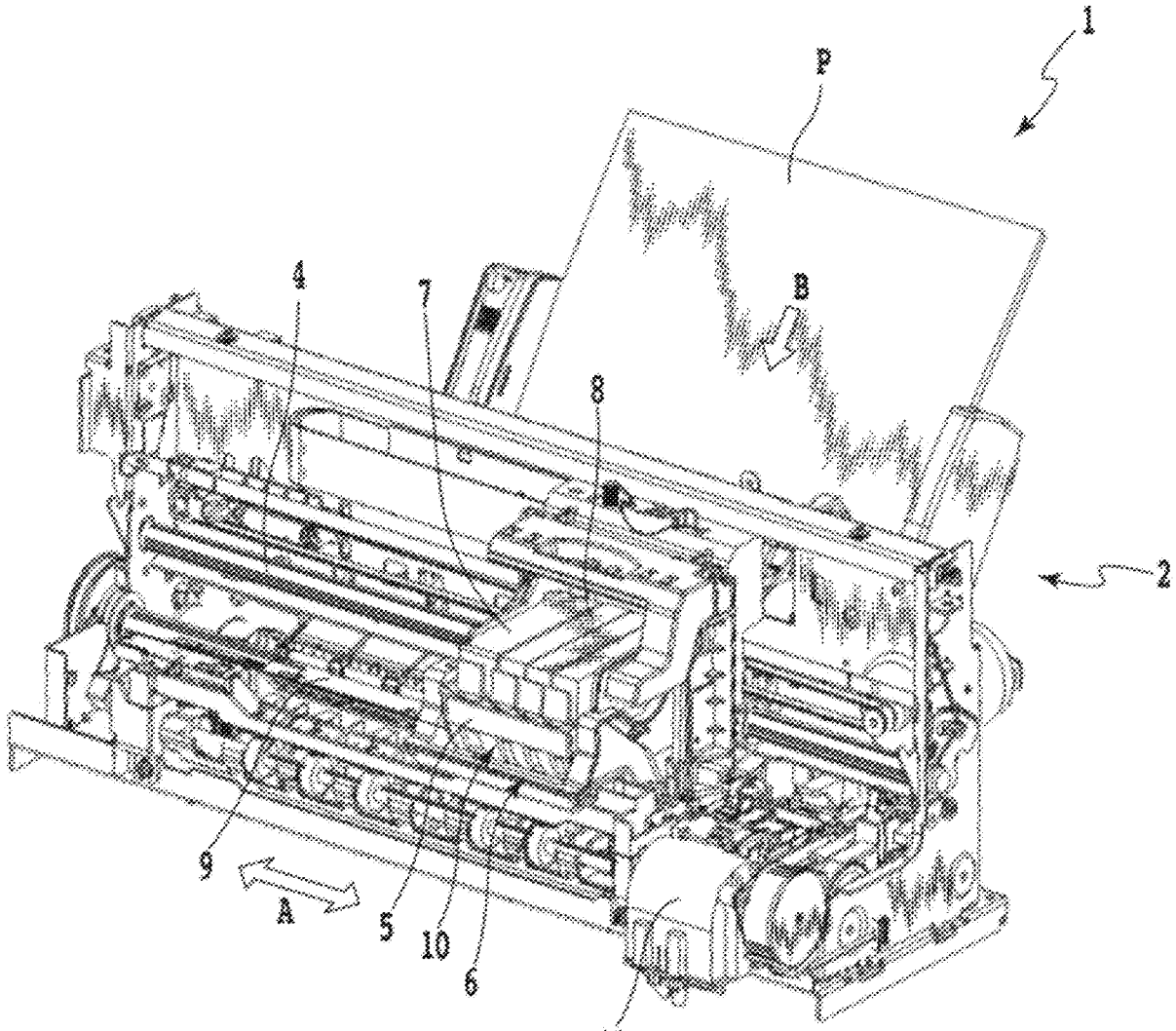
FIG. 1 is a perspective view showing an inside of an inkjet printing apparatus of the present invention.

FIG. 1 shows a perspective view of an inside of a printing apparatus 1 in the present embodiment. An automatic sheet feeder (ASF) 2 having a tray for placing printing media thereon and a conveying mechanism to convey the printing media is attached to the printing apparatus 1. A plurality of printing media P stacked is placed on the tray of the automatic sheet feeder 2. Further, the printing apparatus 1 of the present embodiment is a serial-scanning printing apparatus, and a carriage 5 is guided so as to be movable in a main scanning direction of the arrow A by a guide shaft 4. The carriage 5 is reciprocated in the main scanning direction by a driving force transmission mechanism composed of a carriage motor, a belt that transmits driving force thereof and the like. A plurality of inkjet cartridges in which a print head 6 and an ink tank 7 serving as an ink reservoir part that supplies ink to the print head 6 are integrally formed are mounted according to colors on the carriage 5. The print head 6 and the ink tank 7 may be respectively formed independently.

Figure 2:
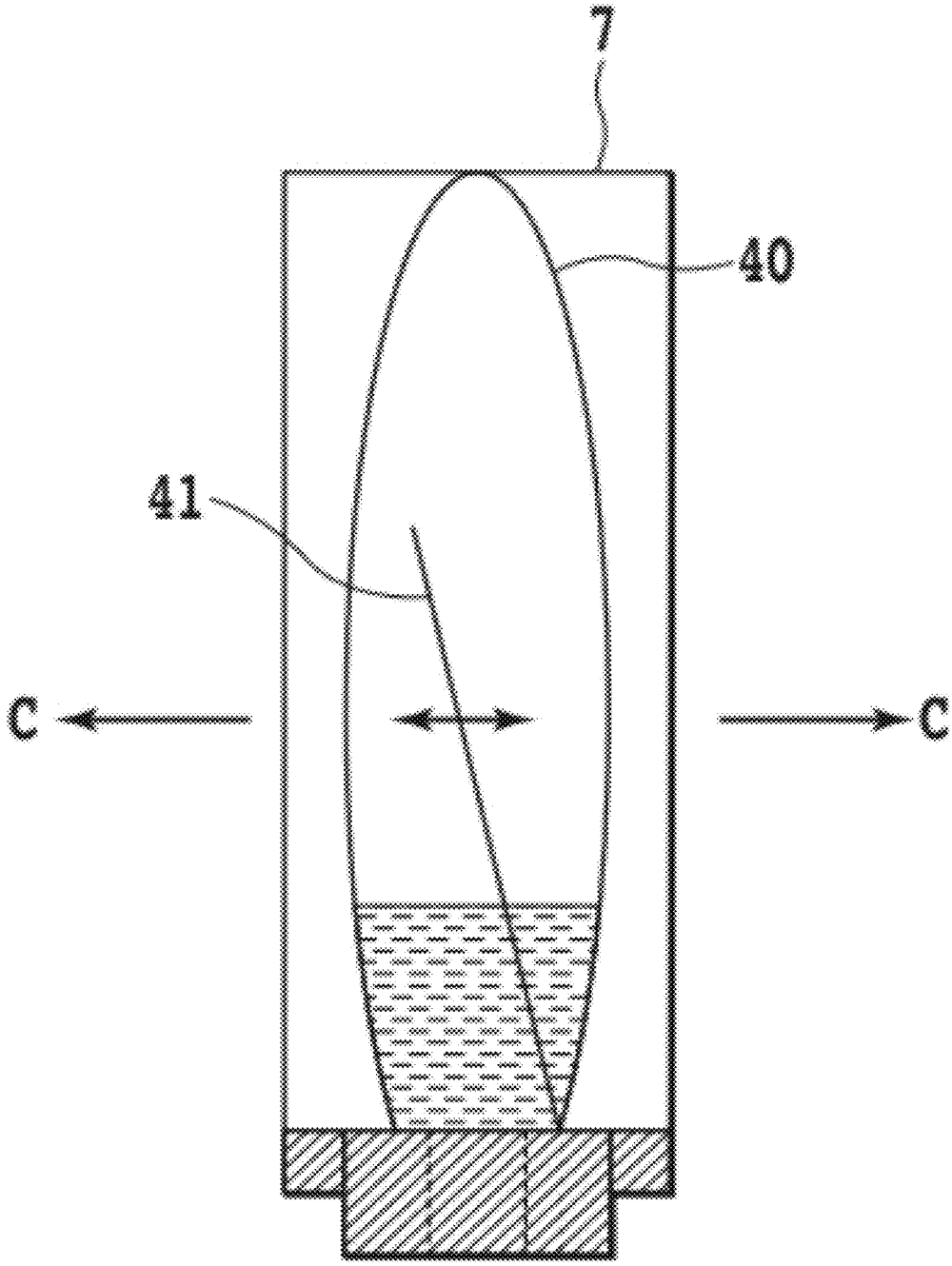
FIG. 2 is a sectional view of an inside of an ink tank mounted in the inkjet printing apparatus.

FIG. 2 shows a sectional view of the ink tank 7. As shown in FIG. 2, a bag 40 is attached to the inside of the ink tank 7, and ink is retained in the bag 40. In the present embodiment, the ink retained in the bag 40 is a pigment ink. In the present embodiment, the ink is directly retained in the bag 40 without using an ink retentive member such as a sponge. When particles of a pigment ink color material are large, separation of the color material component and a solution in the ink is easily caused in some cases. Supposing that a pigment ink is contained in the tank by an ink retentive member such as a sponge, the color material component of the pigment ink may remain in the sponge, and only the solution component may be supplied to the print head 6. In this case, there is a possibility that the color material is not ejected from the print head, which makes it impossible to print a desired image.

An agitating plate 41 serving as an agitation means that agitates the ink is attached together with the ink to the inside of the bag 40 containing the ink. In the present embodiment, the agitating plate is formed in the shape of a plate member, and its one end is fixed so as to be swingable to the ink tank 7. A material and a shape of the agitating plate 41 are determined on the basis of various factors according to the characteristics of the ink to be ejected and the ink tank.

At an end of a moving area of the carriage 5, a recovery system unit (recovery processing means) 11 is arranged at a position facing a forming surface of an ejection port 10 of the print head 6. A cap for capping the ejection port of the head, and a suction pump to induce a negative pressure into the cap are equipped to the recovery system unit 11. The ejection port is covered with the cap, and negative pressure is induced into the cap in this state. Recovery processing ("suction recovery processing") is carried out in order to maintain a favorable ink ejecting state of the print head 6 by sucking ink to discharge it from the ejection port. Further, the recovery processing ("ejection recovery processing") may be carried out in order to maintain a favorable ink ejecting state of the print head 6 by ejecting ink, which does not contribute to image printing, from the ejection port into the cap.

Figure 3:
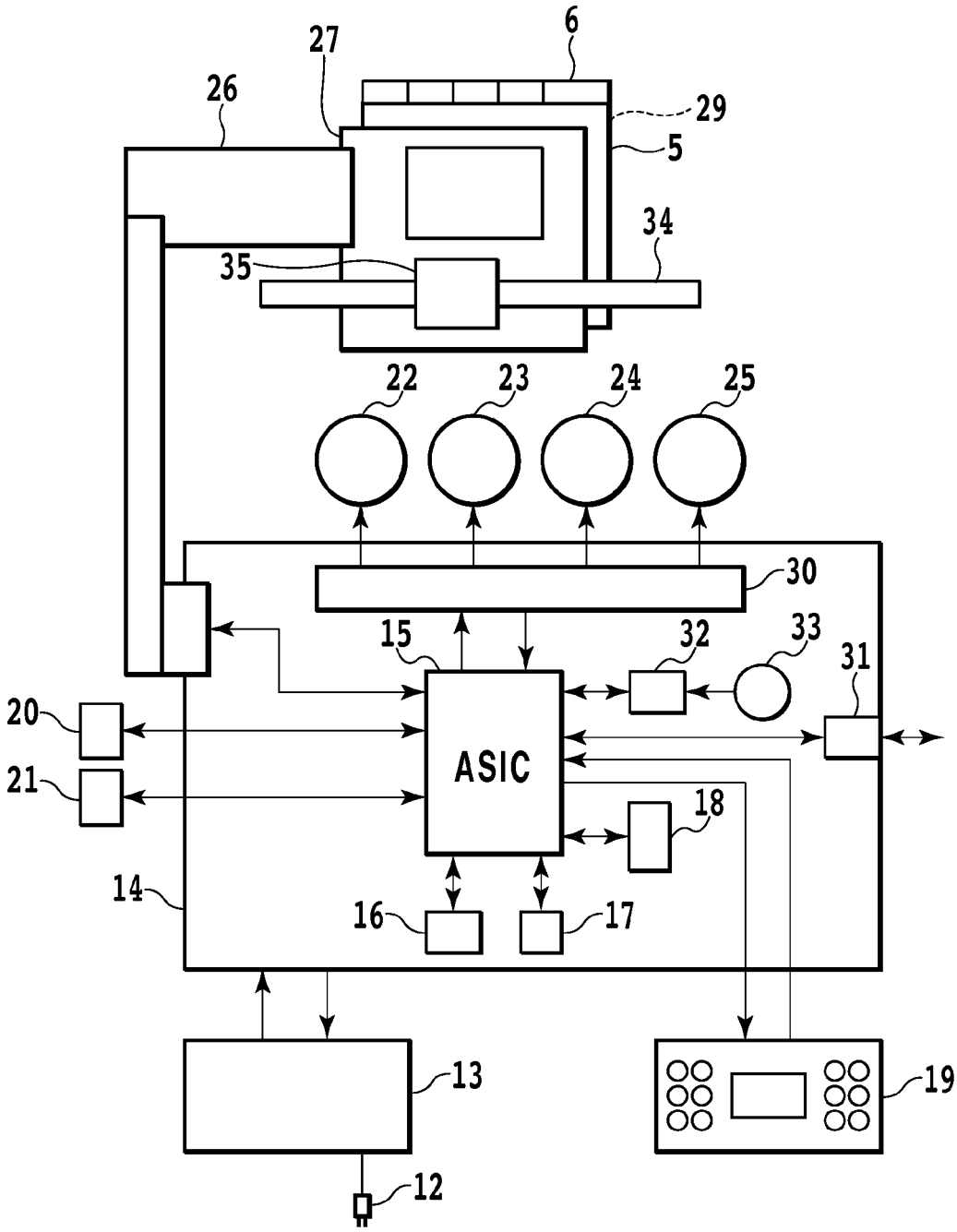
FIG. 3 is a block diagram illustrating a system configuration of the inkjet printing apparatus of the present invention.

FIG. 3 shows a block diagram illustrating the system configuration of the printing apparatus 1 in the present embodiment. As power used for the printing apparatus 1, electric power is acquired through an AC cable 12 from an electric power source. The electric power acquired in this way is supplied to an electric power source unit 13, and an electric current is converted from an alternating current into a direct current to be a predetermined voltage, and the electric power is supplied to a main control substrate 14. Then, the main control substrate 14 distributes the supplied electric power to an ASIC 15 serving as a main controller, nonvolatile memories 16 and 17, a volatile memory 18, a panel unit 19, a sensor 20, an encoder 21, and motors 22, 23, 24, and 25. The electric power supplied from the electric power source is transmitted to the ASIC 15, a carriage FFC (internal wiring cable) 26, a carriage substrate 27, a carriage connector 28, and the print head 6 in this order. A heater (not shown) is attached to the print head 6, and when the electric power is supplied to the heater to operate the heater, heat energy is provided to the ink in the print head 6. In this way, the ink in the print head 6 supplied from the ink tank 29 is ejected from the print head 6 via the ejection port 10.

At this time, the ASIC 15 controls the operations in the printing apparatus 1 as a control unit. The ASIC 15 reads out the program from the nonvolatile memory 16 (for example, a flash ROM, a mask ROM, or the like) storing a control program therein. Then, the ASIC 15 executes the control program while reading and writing data from and into the nonvolatile memory 17 (for example, an EEPROM or the like) and the large-capacity volatile memory 18 (for example, an SDRAM, a DDRAM, or the like) different from the nonvolatile memory 17. In the present embodiment, an amount of ink remaining, setting information on the printing apparatus 1, and the like are stored in the nonvolatile memory 17. Further, the large-capacity volatile memory 18 is used as a work area or the like at the time of processing the program.

At the time of performing printing, the ASIC 15 controls a motor driver IC 30 for controlling the motors 22, 23, 24, and 25 to sense an output signal from the encoder 21 that detects a position, a speed, and a movement direction of the print head 6 which is a controlled object. Further, the ASIC 15 senses the states of objects to be controlled, so as to sense a position of a gear at a position of a cam by a sensor 20, and sense a position of the print head thereby. Further, the ASIC 15 senses an analog signal by an AD converter in order to sense a temperature on the basis of an output from a thermistor, or to sense an excess voltage or the like by a protection circuit. Further, the ASIC 15 receives data from a computer, a digital camera, or a mobile telephone through an I/F (interface) 31.

Acquisition of time information is carried out by using a timer IC 32 (timer circuit) that manages time, and a battery 33 in the present embodiment. When the printing apparatus 1 is connected to a computer and the like, a time can be acquired through the I/F 31. An implementation time for a specific event such as agitation is measured, and thereafter, the time is appropriately stored in the nonvolatile memory 17 for storing settings by the control program. At the time of measuring an implementation time for a specific event, a command access is carried out to a register in the timer IC 32 from the ASIC 15 by using the timer IC 32. As a result, the time information outputted from the timer IC 32 is gradually stored in an address mapping determined by the control program on the nonvolatile memory 16 by the ASIC 15. When an attempt is made to calculate an amount of time elapsed (for example, calculation of an agitation interval), current time information is acquired by the above-described method, and the acquired time information is temporarily stored in the volatile memory 18. Thereafter, time information (for example, a clock time when a previous agitation operation is carried out) stored in advance in the volatile memory 18 is read out to the volatile memory 18 for comparison, and a difference therebetween is calculated. When there is no timer IC 32, the ASIC 15 accesses to a host computer having time information, and acquires the respective times to execute a method the same as the aforementioned method. The advantage of the timer IC 32 is the capability to acquire time information without connecting to a host computer and the like. However, because the timer IC 32 is required to have a dedicated IC, an oscillator, and an electric power source, there are problems in terms of cost and the mounting area on the substrate, an optimum method is determined according to a specification of the printing apparatus 1.

(2) Description of Printing Operation

A printing medium P is inserted into the printing apparatus 1 from the automatic sheet feeder 2 provided in the rear of the printing apparatus 1 to be conveyed. At that time, the printing medium P is conveyed in a sub-scan direction of the arrow B up to a printing area of the print head 6 by an ASF (automatic sheet feeder) motor, a PF motor (paper feeding motor), and an LF motor (paper transporting motor) (not shown). In printing, while the printing apparatus 1 makes the print head 6 to move in the main scanning direction, the ink is ejected onto a printing area on the printing medium P, which performs a printing operation. When printing of one scanning is performed, the printing medium P is conveyed in the sub-scan direction by a distance corresponding to the printed width. Repeating such processes sequentially prints images on the printing medium P.

The ASIC 15 serving as a main controller controls various motors such as the ASF motor, the PF motor, and the LF motor, by the motor driver 30 to convey the printing medium. The motor driver 30 is a high voltage-resistant switching IC to make a large-current flow at a high voltage to drive the motors. The motor driver 30 receives a command from the ASIC 15, and drives the motors according to the command. The DC motors (direct-current motors) are used in the present embodiment. The ASIC 15 controls an ADF (automatic document feeder) encoder, a PF (paper feeding) encoder, an LF (paper transporting) encoder, and the like in order to sense various mechanical factors (for example, a rotational angle of the gear and a rotational position of the shaft).

When the control program stops the various motors not directly linked to a printing operation by the ASIC 15 in order to perform printing onto the printing medium P, the print head 6 moves in the main scanning direction by scanning of the carriage to perform printing. The carriage 5 is moved by the carriage motor 22 while sensing a position of the carriage 5 with an encoder strip 34 and a carriage encoder 35 on the carriage substrate 27. While performing the scanning, the heater of the print head 6 is driven on the basis of positional information of the carriage 5 by the carriage encoder 35. The ink is ejected onto the printing medium P from the predetermined ejection port 10. When one scanning amount of this process is performed, the main controller conveys the printing medium by an amount of the next printing area by the LF motor while sensing a position thereof by the LF encoder. After this operation is repeated to complete a print operation for one page, the ASIC 15 drives the LF motor to perform the control to discharge the printing medium onto which the printing is completed from a paper discharge opening.

In the present embodiment, with regard to the amount of the printing medium P to be conveyed is based on the amount of next printing to be performed. However, the amount of printing medium P to be conveyed is not limited thereto. A plurality of conveying amounts may be set or a conveying amount different from an amount of next printing to be performed may be set according to a printing mode set in the printing apparatus 1.

Various types of setting values at the time of controlling the printing apparatus 1 are determined on the basis of conditions such as a characteristic of printing media, a printing quality level set by a user, a printing speed (printing time), a type of an ink ejected from the printing apparatus, a characteristic of a print head, and the like. Further, a fixing characteristic of ink on a paper surface (which is determined in accordance with a composition of the ink, a characteristic of the printing medium, and the like), and a characteristic of the ASIC 15 serving as a main controller that drives the printing apparatus 1 including processing capacity for image processing may be added therewith. Electrical characteristics inherent to the printing apparatus 1 such as the number of nozzles which can be simultaneously driven, a drop in voltage at that time, and the like, or a specification according to each of the other products may be added therewith.

This is the same as in the driving of the carriage 5. A user sets a type of printing media, a quality level of printing, and a printing speed through printer driver software for controlling the printing apparatus 1 operated on the computer connected to the printing apparatus 1 by a user. In setting of a type of printing media, a printing mode is set from among printing modes stored in advance in accordance with a printing medium to be used from among, for example, a high-grade photo paper, a plain paper, and a matte paper, or the like. Insetting of a printing speed, a printing speed corresponding to a printing purpose is set from among, for example, printing for photograph, printing of only characters, and rapid printing, or the like. At this time, a constant speed, an acceleration distance, and an accelerated velocity at the time of scanning of the carriage 5 are determined according to a set printing mode. A constant speed of the carriage 5 denotes that a speed during scanning of the carriage 5 is within a constant range, and is a speed mainly at the time of ejecting ink. An acceleration distance of the carriage 5 is a distance at which the carriage 5 starts accelerating after temporarily stopping at the both ends of scanning, to reach a constant speed. An accelerated velocity is an accelerated velocity at the time of an accelerating stage until the carriage 5 reaches a constant speed in scanning.

An accelerated velocity and an acceleration distance of the carriage, and a speed when the carriage reaches a constant speed differ in accordance with a printing mode to be set. A printing speed becomes involved in a printing quality level. For example, there is a printing mode called a draft mode. A draft mode is a printing mode in which printing is performed with a typical printing medium such as a plain paper in a simplified manner. In such a printing mode, a printing speed is high, and a quality level of an image is not so high. In a draft mode, a speed in a constant speed range when the carriage comes into a constant speed state after accelerating from the stopped state is high. Further, in such a printing mode, the apparatus is set such that the ink is ejected onto a printing medium even in an acceleration range in some cases. In this case, a speed of conveying the printing medium is high, and at the time of forming an image, the image is printed with a small number of printing passes (for example, a text in four lines is printed by one scanning of the carriage). In such a printing mode, a printing speed is made high by suppressing the accuracy of conveying the printing medium, the accuracy of impacting ink, ink absorption of the printing medium, and the like to some extent. Accordingly, such a printing mode is used in a case in which it suffices to practically decide that the image quality of an image to be obtained is not necessarily high, i.e., in a case in which the image quality to an extent that the outline can be distinguished may be enough.

On the other hand, in a printing mode in which high-quality printing is performed with a high-grade paper such as photo paper, a speed in case of a constant speed range of the carriage and in case of an acceleration range of the carriage is slow. In this printing mode, an acceleration distance is short. Further, conveying the printing medium is also carried out slowly, and a large number of passes are required for forming an image (for example, a text in four lines is printed by four round trips of scanning of the carriage). In this printing mode, although a printing speed is slow, the accuracy of conveying paper, the accuracy of impacting ink, ink absorption of paper, and the like are excellent, which leads to a printing result with high image quality. In this way, the printing apparatus carries out control differing according to a printing mode of a plurality of patterns.

The data about a constant speed, an acceleration distance, and an accelerated velocity of the carriage corresponding to printing conditions (a printing mode) a restored in advance in a program ROM in the nonvolatile memory 16. The ASIC 15 reads out a printing mode (a type of a printing medium, a quality level and a speed of printing) from among received data received from the I/F 31 to be stored in the volatile memory 18. The ASIC 15 makes a reference with the information in the program ROM in the nonvolatile memory 16 in accordance with the read printing mode, to acquire a constant speed, an acceleration distance, and an accelerated velocity of the carriage.

(3) Description of the Outline of Agitation Operation

Next, an agitation operation in the present embodiment will be described. In the present embodiment, an agitation operation is carried out by repeating a reciprocating motions in the scanning direction of the arrow A in FIG. 1 of the inkjet cartridge in which the ink tank 7 and the print head 6 are integrally formed. The agitation operation is carried out by reciprocating motions of the inkjet cartridge mounted on the carriage 5 independently of a printing process in order to prevent unevenness in the concentration of the ink to be ejected from the print head 6. During the agitation operation, ink ejection from the print head is not performed.

When the inkjet cartridge reciprocates in the scanning direction, inertia causes the agitating plate 41 to sway in the direction of arrow C as shown in FIG. 2. The ink in the ink tank 7 is agitated by the motion of the agitating plate 41.

The agitating plate 41 is not necessarily essential. Even without the agitating plate 41, the inkjet cartridge reciprocates by scanning of the carriage, and the ink in the ink tank 7 is waved to be agitated due to inertia. The effect due to an agitation operation becomes greater with the agitating plate 41, and the ink tank 7 preferably includes the agitating plate 41. Further, when an agitating plate is attached to the ink tank, variations are caused in the effect due to the agitation operation according to a material and a shape of the agitating plate 41. Thus, a level of the effect due to an agitation operation is determined according to the respective configurations including the shapes of the agitating plate 41 and the ink tank 7.

The ink to be supplied to the print head 6 from the ink tank 7 is supplied to the print head 6 through a supply path (not shown) from the ink supply port 42 in the ink tank 7. When a state in which printing is not performed is continued, a color material component and a liquid component in the ink inside the ink supply path are separated, which results in a concentration difference between the upper and lower portions in the ink supply path. With respect to the concentration difference as well, in the same way as the inside of the ink tank 7, a concentration difference is suppressed by an agitation operation of the inkjet cartridge, and its concentration is equilibrated.

(4) On Agitation Parameter

FIG. 4 shows a table in which levels of agitation in which the ink in the ink tank is agitated are converted into agitation operations carried out at times except for a time of printing operation by a carriage scanning at the time of printing operation. In an agitation operation carried out at a time except for a time of printing operation, the number of scanning movements of the carriage in the agitation operation is set by using an agitation parameter. In the present embodiment, an agitation parameter is determined according to a type of a printing medium and a printing mode specified by a user by using the table of FIG. 4. The carriage 5 reciprocates right and left for a printing operation on the basis of a printing mode set at the time of a printing operation. An accelerated velocity and an acceleration distance until the carriage reaches a constant speed state from a stopped state at the both ends of the movement, and respective speeds when the carriage reaches a constant speed are derived, and an agitation conversion parameter can be determined on the basis of those. An accelerated velocity and an acceleration distance from a stopped state up to a constant speed, and respective speeds at a constant speed of the inkjet cartridge mounted on the carriage differ according to a printing mode. The agitation parameter conversion table is a table set so as to correspond to printing modes in advance, and is stored in the program ROM stored in the nonvolatile memory 16 on the main control substrate 14. The concrete usage of the agitation parameter determination table will be described later by using sequences of FIG. 7 and later. Note that, in FIG. 4, three tables are to be used. However, many more tables may be used.

(5) Parameter on Amount of Remaining Ink

Figure 5:
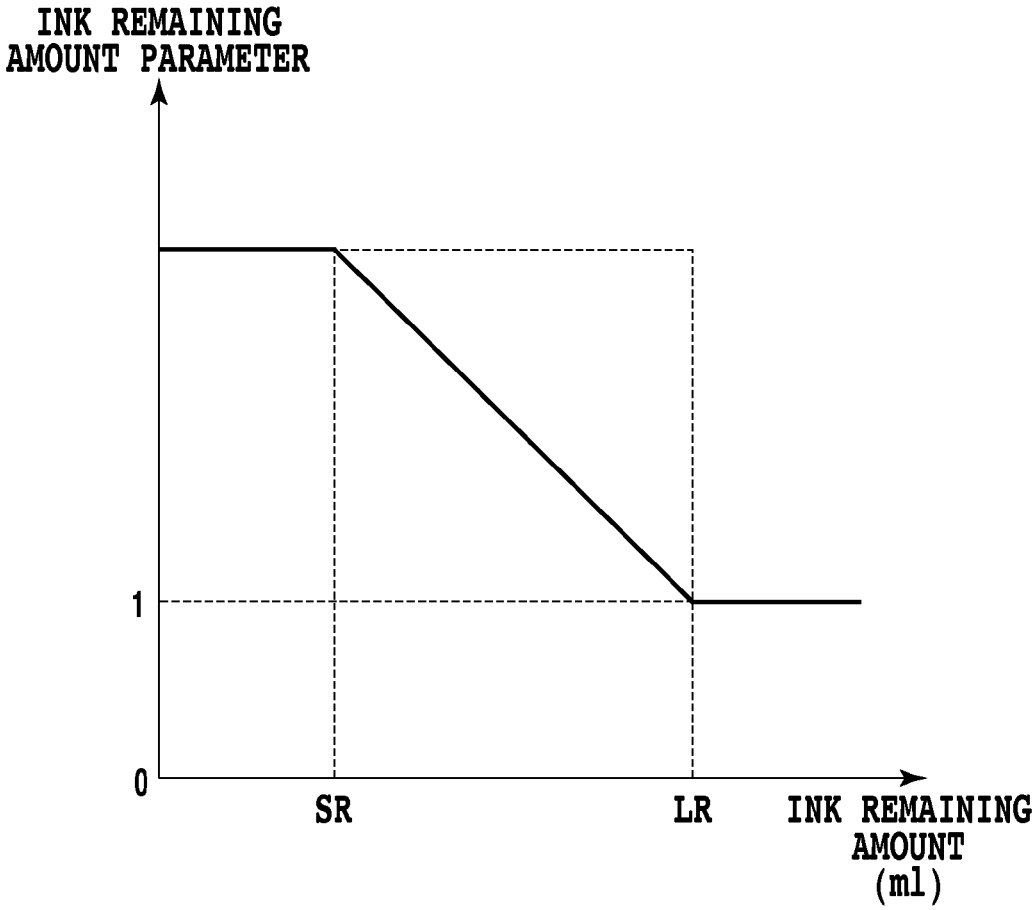
FIG. 5 is a graph showing a relationship between an amount of ink remaining parameter and an amount of ink remaining.

FIG. 5 shows a graph of a relationship between an amount of ink remaining parameter and an amount of ink remaining. In a case in which there is linearity between an amount of ink remaining and an amount of ink remaining parameter, the amount of ink remaining parameter may be derived by a calculation. In the present embodiment, the graph of FIG. 5 is stored in advance in the program ROM. Amounts of ink remaining are plotted on the abscissa of the graph. The unit in the present embodiment is ml. However, the unit may be greater and may be less depending on devices in some cases.

Amount of ink remaining parameters are plotted on the ordinate. A method for reflecting an amount of ink remaining parameter to an agitation conversion parameter will be described later in the descriptions of FIG. 7 and later. When an amount of ink remaining is greater than or equal to a specified value LR, agitation by a reciprocating motion of the tank easily has an effect because an amount of ink remaining is sufficient, and a reciprocating motion of the carriage in a printing operation directly has an effect on the agitation. Waving of ink is slight in an area in which an amount of ink remaining in the ink tank 7 is less than the specified value LR, which may result in a smaller effect due to an agitation operation. Therefore, at the time of determining the number of agitating times and the like, many agitation operations are carried out by multiplying a coefficient greater than 1. In view of an amount of ink remaining, because the ink is contained in a sufficiently great amount in an area in which an amount of ink remaining is greater than or equal to the specified value LR in the present embodiment, a coefficient for an agitation conversion parameter determined by using FIG. 4 is used as 1 directly. In this way, an agitation conversion parameter taking into account an amount of ink remaining is calculated by integrating an amount of ink remaining parameter determined on the basis of the amount of ink remaining.

The term "specified value LR" here denotes a threshold value set such that there is no need to carry out an agitation operation when an amount of ink remaining is greater than LR, and an agitation operation is required when an amount of ink remaining is less than LR. This is a value obtained in advance from experimentation, and a value determined in accordance with a composition of ink, a configuration of an ink tank, a color of ink, and the like. The value is set in advance in the graph shown in FIG. 5 stored in the program ROM. As a method for sensing an amount of ink remaining used at the time of referring to the graph, a method by an optical sensor, an electrostatic method, or a method for calculating an amount of an ejecting amount of ink may be used. In the present embodiment, a method for calculating an amount of ink remaining by counting the number of ejecting times of ink is employed. In the present embodiment, at the time of replacing the tank or the cartridge, a replacement of it with a new ink tank by a command from a user is to be input to the inkjet printing apparatus. A remaining amount of each ink tank is stored in a corresponding address provided for each color in the nonvolatile memory for storing settings of the printing apparatus 1. When the tank is replaced with a new one, an amount of ink remaining is set as a full value in view of the new tank. Thereafter, every time ink is ejected from the print head 6, the number of times of ejection is counted, and the value is subtracted from the value in the memory that manages an amount of ink remaining to update the amount of ink remaining. In a case in which the print head 6 has a plurality of ejection ports with different opening diameters, when an amount of ink remaining is calculated, the number of times of ink ejection and an ink ejected amount from each ejection port are integrated. A consumed ink amount may be calculated by adding the calculated ink ejected amounts from each of the ejection ports.

When the ink tank was replaced, the matter may be memorized in the printing apparatus 1 by an operation by a user (who can instruct it by switches, a printer driver, and the like). The printing apparatus 1 may recognize that the ink tank is a new ink tank by accessing to an ID chip of the ink tank, and judge that the ink tank has been replaced with the new ink tank. The printing apparatus 1 may recognize that the ink tank has been replaced with the new ink tank by sensing a state of an installed ink tank.

A case in which an amount of ink remaining is less than or equal to the specified value LR and greater than or equal to a saturation value SR will be described. The saturation value SR is a threshold value as to whether it is an area or not where an amount of ink remaining in the ink tank becomes less, and it becomes difficult to exert an effect due to agitation, which results in an impossibility of having an effect due to agitation. The saturation value SR is a value determined in advance by experimentation, and stored in the program ROM.

When an amount of ink remaining is less, even when a reciprocating motion of the carriage in a printing operation is performed, it becomes difficult to exert an agitation effect due to the effect thereof. Therefore, many agitation operations are required. An amount of ink remaining parameter is finally integrated with respect to an agitation conversion parameter to determine the number of scanning movements of the carriage as an agitation operation. In order to reflect a value of an amount of ink remaining parameter to the number of scanning movements of the carriage, a value of an amount of ink remaining parameter is set to be greater than 1. In the graph shown in FIG. 5 of the present embodiment, the relationship between an amount of ink remaining and an amount of ink remaining parameter is linear in an area in which an amount of ink remaining is less than or equal to the specified value LR and greater than or equal to the saturation value SR. A case in which the relationship in which the amount of ink remaining parameter diminishes with respect to the amount of ink remaining nonlinearly can be supposed. It will be described in the sequences of FIG. 7 and later how to reflect an amount of ink remaining parameter in this case to an agitation conversion parameter.

A case in which an amount of ink remaining is less than or equal to the saturation value SR will be described. Because an amount of ink remaining is extremely low in this area, an effect due to agitation is not exerted by a simple reciprocation scanning of the carriage 5. Accordingly, in this area, even when agitation in the ink tank is carried out on the printing apparatus 1, it may be difficult to recover the homogeneity of ink concentration. Therefore, a replacement of the ink tank may be recommended for a user, or the ink tank may be detached from the printing apparatus 1 to obtain the homogeneity of concentration by an operation with another means. Specifically, a method for applying, not agitation due to a movement in the main scanning direction of the carriage, but vibration in a direction of conveying a printing medium with respect to the ink tank or the cartridge may be used. In order to carry out agitation in a direction of conveying a printing medium, agitation by hands of a user may be carried out, or may be carried out by using a dedicated agitator. It may be considered that raising the ink tank reversely for a given time enables to diffuse particles of precipitated ink. When it is recognized that an amount of ink remaining reaches the saturation value SR, an effect due to agitation is not exerted, and therefore, the number of agitating times is not calculated for an agitation operation in practice. Another means is recommended for the user. Accordingly, when an amount of ink remaining reaches the saturation value SR, the saturation value SR is not used at the time of calculating an agitation conversion parameter. Before an agitation operation, it is judged whether or not the ink concentration can be recovered by an agitation operation by using the saturation value SR serving as a threshold value. When an agitation operation is carried out, an agitation possibility judgment for judging a possibility or an impossibility of agitation in accordance with not only an elapsed time from a previous agitation operation, but also whether or not an amount of ink remaining is over the saturation value SR is carried out.

Note that, when an amount of ink remaining parameter is determined, an amount of ink remaining parameter may be determined with reference to a table on amount of ink remaining parameters. Further, in a case in which there is a certain principle for calculating an amount of ink remaining parameter, a calculating formula for obtaining an amount of ink remaining parameter is prepared in advance, and an amount of ink remaining parameter may be determined on the basis of the calculating formula.

(6) Agitation Interval Parameter

Figure 6:
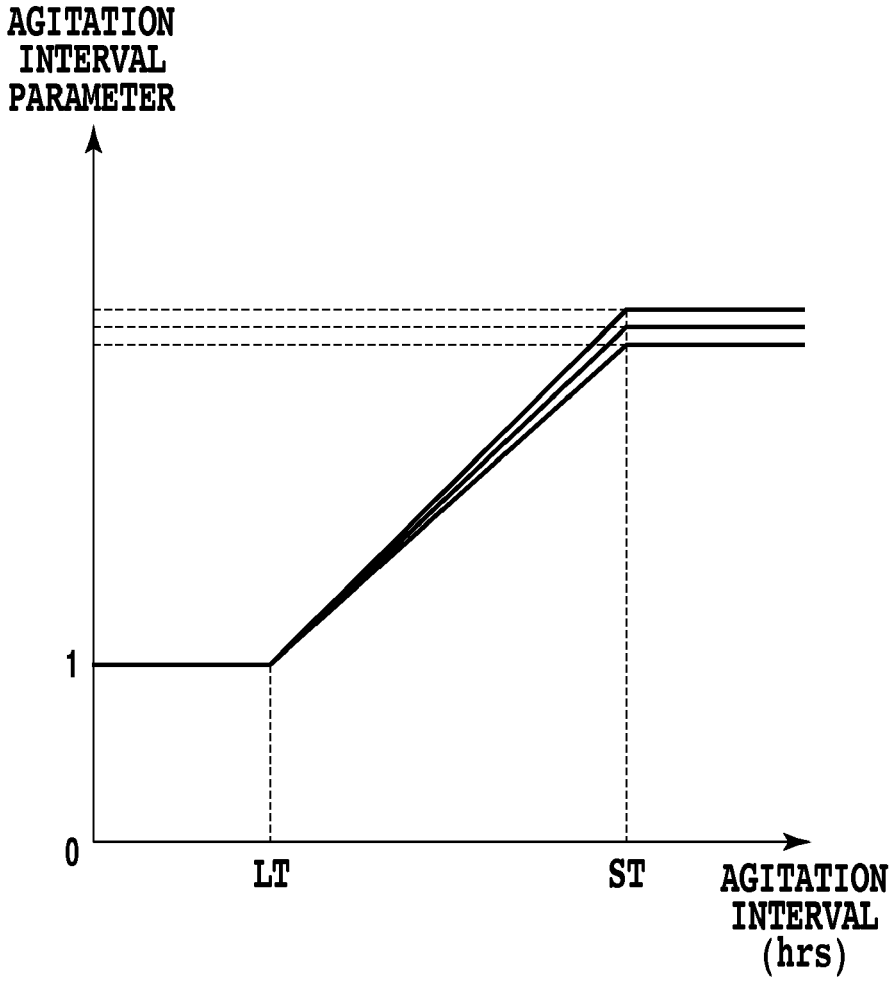
FIG. 6 is a graph showing relationships between agitation interval parameters and agitation interval times.

FIG. 6 shows a graph for converting an effect on an interval between agitation operations into an agitation interval parameter. In the graph shown in FIG. 6, a plurality of graphs on a plurality of ink types are shown. FIG. 6 shows that effects of differences in the ink types can be converted into agitation interval parameters.

The relationships between a time interval of agitation operations and an agitation interval parameter are obtained as the graphs in advance by experimentation. At the time of determining an agitation interval parameter, the relationships stored in the program ROM of the control unit are referred to. Agitation interval parameters with which it is possible to calculate the number of reciprocating motions of the print head taking into account a time interval between agitation operations, are plotted on the ordinate of the graph in FIG. 6. Agitation interval parameters are for determining an agitation operation by taking into account amount of ink remaining parameters and agitation conversion parameters which will be described later. Times of agitation intervals are plotted on the abscissa. An agitation interval is an elapsed time from a previous agitation operation to a current agitation operation. The carriage 5 is made to reciprocate every time managed by a timer to carry out an agitation operation that improves the uniformity of ink concentration in the ink tank. A method for calculating an agitation interval will be described later in the sequences of FIG. 7 and later. In the present embodiment, hours (hrs) are used as units of times used in the graph shown in FIG. 6. However, days or minutes are preferably used as units in some cases.

When an agitation interval parameter is calculated in view of an interval between agitation operations, the table stored in advance in the ROM may be referred to. When an agitation interval and an agitation interval parameter is in a nonlinear relationship, a table may be prepared in view of the contents thereof. A relationship between a time interval of agitation operations and an agitation interval parameter is determined in advance as a table or a calculating formula by experimentation. An agitation interval parameter to convert an effect on a level of agitation is set on the basis of an elapsed time from a previous agitation operation. With regard to the number of reciprocating motions of the carriage in an agitation operation, the number of reciprocating motions of the carriage in a current agitation operation is calculated by multiplying the number of planned reciprocating times of the carriage before adding a time interval from a previous agitation operation by an agitation interval parameter.

A progression rate of settling out of pigment ink differs for every printing apparatus. Reflection of a progression rate of settling out to an agitation interval parameter will be described later. The reason for this is that a progression rate of settling out in the ink tank differs in accordance with a difference in specific gravity between a color material and a solvent and a configuration of a tank (there are some cases in which a tank differs according to a color).

When a rate of settling out differs, a difference is caused in an effect on an image exerted by color shading. When an agitation interval is less than or equal to the specified value LT at a predetermined agitation time, settling out of the pigment ink does not progress very much. Accordingly, reciprocation scanning of the carriage 5 in a typical printing operation easily has an effect on improving the settling out of ink by agitation. In order to recover ink concentration, there is no need to carry out an agitation operation having no relationship with a printing operation from the ejection port. A situation is made in which the ink in the ink tank 7 is sufficiently agitated only by the reciprocating motion of the print head 6 in printing. Therefore, when an agitation interval is less than or equal to the specified value LT, no agitation operation other than a movement of the carriage in printing is carried out. In the present embodiment, given that a specified value is LT, a coefficient to reflect an involvement of an agitation interval parameter with respect to an agitation conversion parameter is set to 1. A specified value is a setting value which is determined in advance by experimentation or a specification, and stored in the program ROM of the main control substrate 14 of the main body, and a threshold value with which it is judged whether or not an agitation operation is necessary on the basis of an elapsed time from a previous agitation operation.

In the area in which an agitation interval is greater than the specified value LT and less than or equal to a saturation value ST, it becomes more difficult to bring about an agitation effect by a movement of the carriage in proportion to an agitation interval thereof. In this area, because the ink gradually precipitates, the color material sinks down on the bottom of the ink tank as time elapses, which results in a difficulty of diffusing the ink even by agitation. With regard to a calculation of the number of agitating times, an agitation interval parameter taking into account an agitation interval is integrated with respect to an agitation conversion parameter. As in the present embodiment, in a case in which an agitation interval is greater than the specified value LT and less than or equal to the saturation value ST, the settling out of the ink may progress, and an agitation interval parameter is set to 1 or more, and the agitation interval parameter is integrated with respect to an agitation conversion parameter. Because the settling out of the ink progresses and it becomes more difficult to bring about an agitation effect by a reciprocating motion of the carriage, it is judged that more agitations are required. The reason that the graphs of the agitation interval parameters have different slopes in FIG. 6 is that a progression rate of settling out differs for every ink color. The relationship between the specific gravities of a color material and a solvent differs every ink color, and an effect on an image by a concentration difference differs.

When an agitation interval is greater than or equal to the specified value LT, it is a case in which an agitation operation other than a movement of the carriage in printing is separately required. The specified value LT of an agitation interval is one of the factors for judgment to determine whether or not an agitation operation other than that in printing is required. When an agitation interval is less than or equal to the specified value LT, it is judged that the ink in the ink tank 7 is sufficiently agitated only by a movement of the carriage for printing. Therefore, an agitation operation by a movement of the carriage other than that in printing is not required.

An area in which an agitation interval is greater than or equal to the saturation value ST is an area in which an effect of agitation is no longer exerted by a simple reciprocating motion of the carriage 5. In this area, it may be difficult to recover the homogeneity of ink concentration by agitation of the ink tank by the printing apparatus. Accordingly, a user may be recommended to replace the ink tank, or the ink tank may be detached from the printing apparatus and agitation may be carried out by another means. For example, an effect of agitation by scanning of the carriage varies in accordance with an outer shape in which a shape of the ink tank is longer in a direction which is the same as the scanning direction of the carriage or in a direction intersecting the scanning direction of the carriage when an ink tank is mounted on the printing apparatus. If vibration in a direction of conveying a printing medium can be applied to the tank, an effect of agitation is higher than that of agitation only in the main scanning direction. Accordingly, agitation by hands of a user, agitation by a dedicated agitator capable of agitating in a direction of conveying a printing medium can be considered. In addition thereto, an attempt may be made to uniformly set out of the precipitated ink by changing the orientation of the ink tank reversely for a given time in the printing apparatus.

The saturation value ST is a threshold value with which it is judged whether or not ink concentration can be recovered by an agitation operation by a reciprocating motion of the inkjet cartridge on the basis of an elapsed time from a previous agitation operation. Before an agitation operation, it is judged whether or not ink concentration can be recovered by using the saturation value ST serving as a threshold value.

(7) Sequence for Calculating Various Parameters in Printing Operation.

Figure 7:
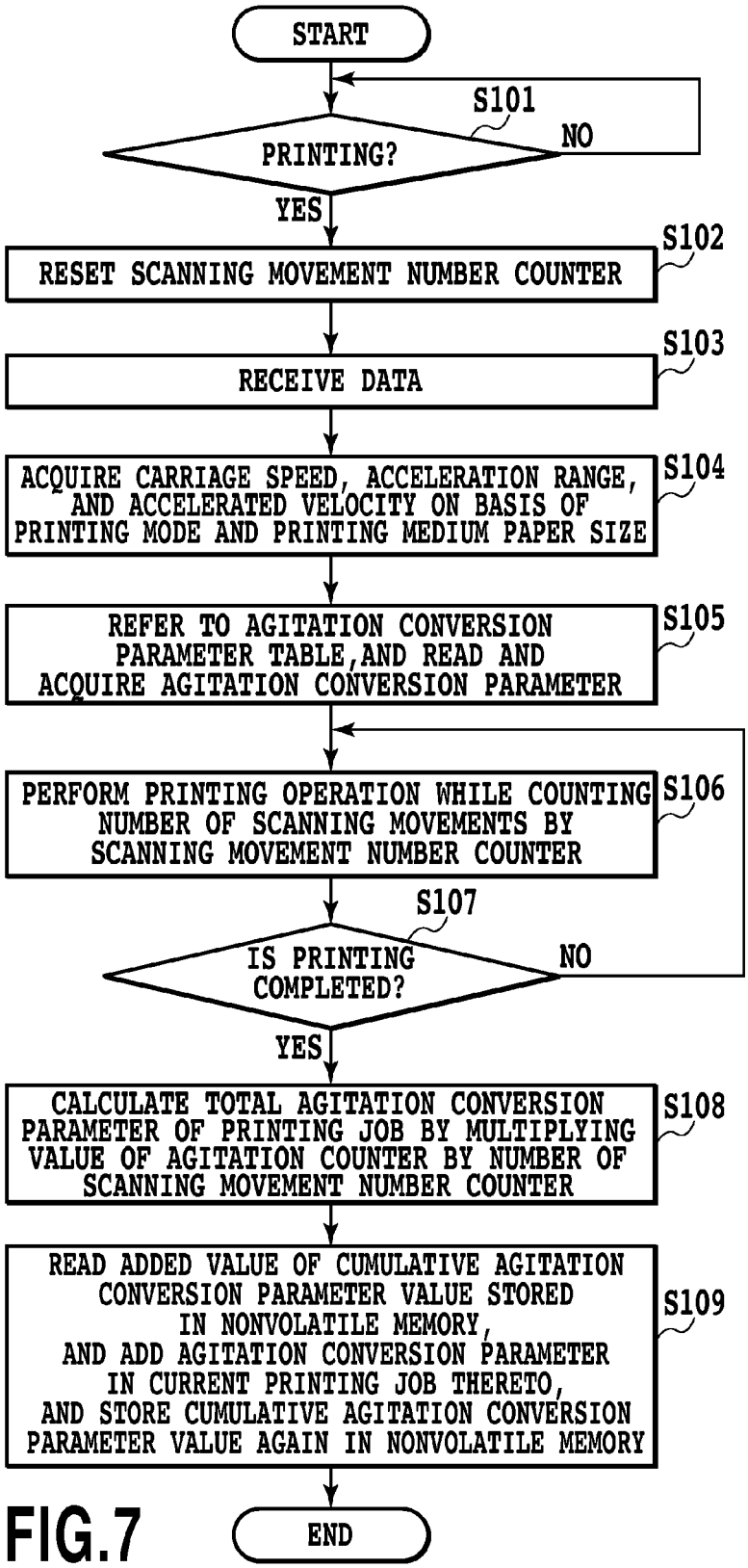
FIG. 7 is a flowchart for determining various types of parameters for agitation.
Figure 8:
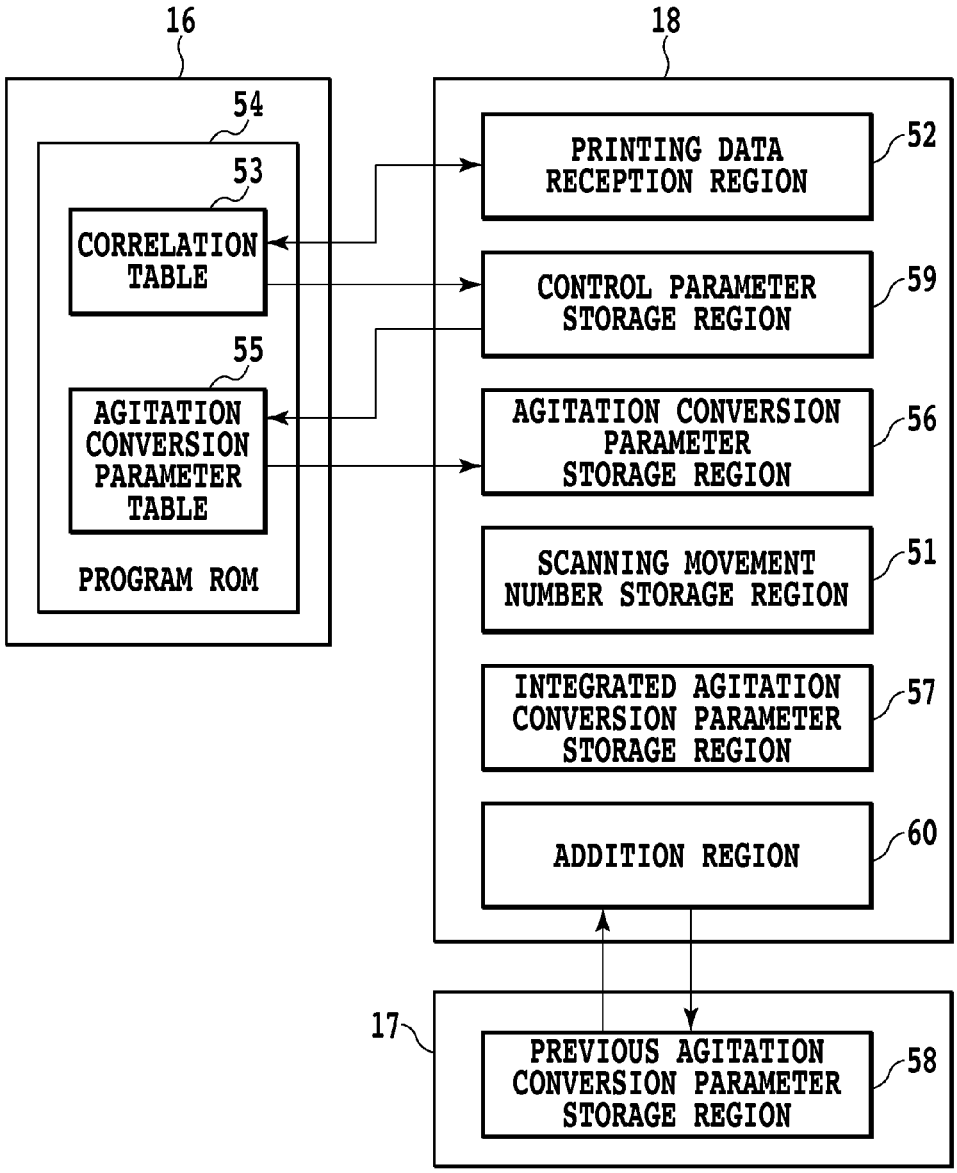
FIG. 8 is a block diagram showing the flows of data when an agitation conversion parameter is calculated.

FIG. 7 shows a flowchart of a method for calculating an agitation effect by a reciprocating motion of the carriage of the present invention. FIG. 8 shows the flows of data in the memory achieved at that time.

First, it is judged whether or not a printing operation is carried out (S101). Next, the number of scanning movements in a carriage scanning movement number storage region 51 in the volatile memory 18 connected to the main control substrate 14 as a main controller unit of the printing apparatus 1 is cleared (S102). This is a process at a preparatory stage for counting the number of scanning movements in printing to be performed from now. Next, the main control substrate 14 of the printing apparatus 1 receives printing data from devices such as a personal computer through the I/F 31 and the like (S103). At that time, prior to the reception of the printing data, printing information such as a printing mode is set. Next, the main control substrate 14 receives printing data at a printing data reception region 52 through the I/F 31. The main control substrate 14 reads out printing parameters (settings for a type of paper, a printing quality level, and a printing speed) from the printing data stored in a receive buffer. These pieces of information are collaterally included in the printing data transferred to the printing apparatus 1, and it is possible to distinguish those according to a command, which makes it easy to extract information. Thereafter, with reference to control parameters (a constant speed, an acceleration distance, and an accelerated velocity of the CR (carriage)) of the printing apparatus 1 on the basis of the printing parameters, control parameters are acquired (S104). A correlation table 53 there among is stored in advance in a program ROM 54 stored in the nonvolatile memory 16. The read control parameters are stored in a control parameter storage region 59 in the volatile memory 18. Next, with reference to an agitation conversion parameter table 55 stored in the program ROM 54 on the basis of the stored control parameters, an agitation conversion parameter is acquired (S105). The read agitation conversion parameter is stored in an agitation conversion parameter storage region 56 in the volatile memory 18. On the basis of an accelerated velocity and an acceleration distance until the carriage comes into a constant speed state from a stopped state in scanning of the print head, and a speed in a constant speed state, an agitation conversion parameter in printing is set. The agitation conversion parameter is a parameter in which a level of agitation by scanning of the carriage in printing is converted into an effect of agitation in an agitation operation except for that at a printing time. Eventually, the number of reciprocating motions of the carriage in an agitation operation is calculated such that the number of agitating times calculated on the basis of an agitation conversion parameter is subtracted from an initial value of the number of reciprocating motions of the carriage in an agitation operation set in advance. At step S105 in FIG. 7, an agitation conversion parameter per scanning in a printing operation to be performed from now is acquired, and the number of agitating times converted from the number of movements of the carriage in printing is calculated thereby. In this way, in an agitation operation in the present embodiment, the number of reciprocating motions in which the carriage is made to reciprocate for printing is converted into the number of reciprocating motions for agitation with reference to a constant speed, an acceleration distance, and an accelerated velocity of the carriage in view of conditions for various printing modes, and a final agitation operation is determined.

In the printing apparatus 1, scanning of the carriage is performed in a serial scanning method. At the time of performing a printing operation, the carriage 5 on which the inkjet cartridge is mounted reciprocates in the scanning direction to perform the printing. In printing, the number of scanning movements of the carriage is counted, and the number of scanning movements in the scanning movement number storage region 51 in the volatile memory 18 is updated (S106). This process continues until the printing is completed, and when it is judged that the printing of the received data is completed, the printing process is terminated (S107).

Next, an integrated agitation conversion parameter value of the printing job in total is calculated. Specifically, the agitation conversion parameter per scanning stored in the volatile memory 18 at S105 and the counted-up number of scanning movements of the printing job are multiplied. In this way, an agitation conversion parameter value acquired by scanning in current printing is calculated, and an integrated agitation conversion parameter value after the completion of the printing job is stored in an integrated agitation conversion parameter storage region 57 shown in FIG. 8 (S108).

Next, a value of a past integrated agitation conversion parameter is read out of a previous agitation conversion parameter storage region 58 stored in the nonvolatile memory 17 storing the setting values. A current integrated agitation conversion parameter is added to the read past integrated agitation conversion parameter at an addition region 60. Thereafter, a value of the integrated agitation conversion parameter is updated. The updated value is stored in the previous agitation conversion parameter storage region 58 in the nonvolatile memory 17 in FIG. 8 (S109). An integrated agitation conversion parameter value in one printing job is calculated by the above-described processes.

(8) Sequence of Agitation Operation

Figure 9:
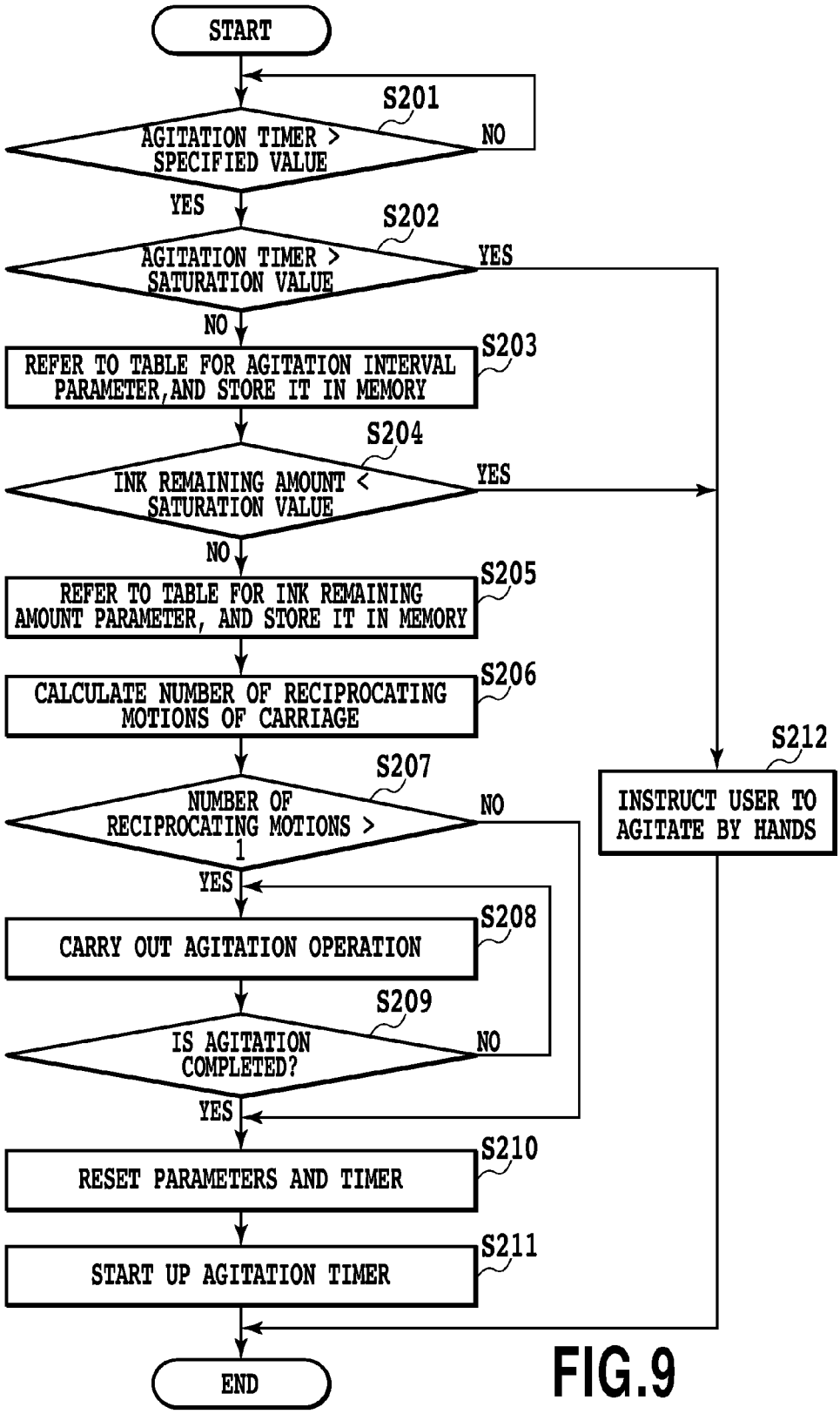
FIG. 9 is a flowchart showing a flow when an agitation operation is carried out.

With reference to FIG. 9, a time interval between agitation operations will be described. First, it is judged whether or not a time interval between agitation operations read by an agitation timer is greater than or equal to the specified value LT (S201). The agitation timer measures a time interval between agitation operations on the basis of the time information which the program ROM manages by using a time acquisition function realized by a timer IC or the like. That is, the agitation timer has a function of measuring an elapsed time from the previous agitation operation on the basis of a time of a previous agitation operation and a current time. At this time, the time of the previous agitation operation is stored in the nonvolatile memory for storing settings of the main controller unit, and this can be read out of the memory. At the judgment at S201, a case in which the agitation timer function is still less than or equal to the specified value LT indicates, not the timing in which an agitation operation is required, but a state in which agitation is unnecessary. On the other hand, a case in which it is judged that a value of the agitation timer is greater than or equal to the specified value LT indicates the necessity of an agitation operation. At this time, a judgment of agitation necessity on an amount of ink remaining whether or not an amount of ink remaining is less than or equal to a specified value may be made.

Next, it is judged whether or not a time interval between agitation operations measured by the agitation timer is greater than the saturation value ST (S202). When an elapsed time from a previous agitation operation is greater than the saturation value ST, even if an agitation operation is carried out for recovery, it is impossible to recover the ink concentration. Accordingly, it is judged as a state in which recovery by agitating the ink tank is impossible. The saturation value ST is determined in advance by experimentation or according to a specification, and is stored in the program ROM in the nonvolatile memory provided to the main control substrate 14 of the main body of the printing apparatus 1. Before the agitation operation, a judgment of agitation necessity to judge whether or not there is a portion whose ink concentration has increased to an extent that recovery of ink concentration by an agitation operation is required, i.e., whether or not an agitation operation is required, is made.

A case in which the printing apparatus 1 has been off with no connection to the electric power source for a long period of time will be described. Differently depending on specifications of the electric power source system, and first, a case in which a low power consumption mode is set in a state in which an AC cable is connected thereto, and a state in which the main control substrate 14 is not stopped continues will be described. The main control substrate 14 is capable of judging whether or not an agitation operation is required. Before the agitation timer exceeds the saturation value ST, the effect that agitation is required is indicated for a user, and the user carries out agitation or the printing apparatus itself performs an agitation operation, which makes it possible to provide a uniform concentration.

Next, a case in which, when an electric supply to the printing apparatus 1 is cut off, an electric power supply from the AC cable with respect to the main control substrate 14 is cut off will be described. Because the main control substrate 14 comes into a stopped state, the main control substrate 14 cannot judge whether or not the agitation timer is greater than the saturation value ST. Further, even if an interval between agitation operations is greater than the saturation value ST, the printing apparatus 1 cannot indicate the effect that agitation is required for a user, and further, cannot make an attempt to provide a uniform concentration by using another means. Thereafter, when the AC cable is connected to the printing apparatus and an electric supply from the AC cable is restarted, the program ROM starts operating. A time of a previous agitation operation is read out of the nonvolatile memory for storing settings of the main control substrate 14, and a current time is acquired by the timer IC, and an elapsed time from the previous agitation operation is judged. At this time, there may be a possibility that a value of the agitation timer is far beyond the saturation value ST. When a value of the agitation timer is far beyond the saturation value ST, concentration separation is brought about in which pigment dyestuff settles out at the lower portion of the tank to stick to the bag, and only the solvent stays in the upper portion in the ink. Judging how much it is possible to improve unevenness in the concentration in the tank by agitation, and how much it is possible to have an effect of agitation depend on conditions inherent to the ink and the ink tank. Thus, there may be the necessity to judge a state in which an agitation effect is not expected. In the present embodiment, a state of the ink in which a desired image concentration cannot be obtained by ejecting ink from the print head is judged as a state in which the recovery by agitation is impossible. When the agitation timer is made greater than or equal to the saturation value, and it is judged that the recovery of the uniformity of ink concentration is impossible only by an agitation operation of the carriage, the routine does not proceed to an agitation operation, and the effect that a replacement of the ink tank or another means is recommended is indicated.

Even when the AC cable is connected to the printing apparatus, in a case in which the control in a low-power consumption mode is carried out to stop the main control substrate 14, the agitation timer is made greater than the specified value ST in some cases. Even when the agitation timer is made greater than the specified value ST, a certain measure of (slight) excess time might be able to be handled in an agitation operation, and it is possible to ease the uniformity of the ink by an agitation operation due to a reciprocating motion of the carriage unit.

When the agitation timer is greater than or equal to the specified value LT and less than or equal to the saturation value ST, in the present embodiment, an agitation interval parameter is read out from the values of the agitation timer by using the agitation interval parameter table stored in advance in the program ROM. The read value is stored in a predetermined area in the volatile memory (S203). This agitation interval parameter table is a table in which the graphs of the relationships between the agitation intervals and the agitation interval parameters, shown in FIG. 6, are stored as tables showing the relationships of the respective numeric values in the program ROM.

Figure 10:
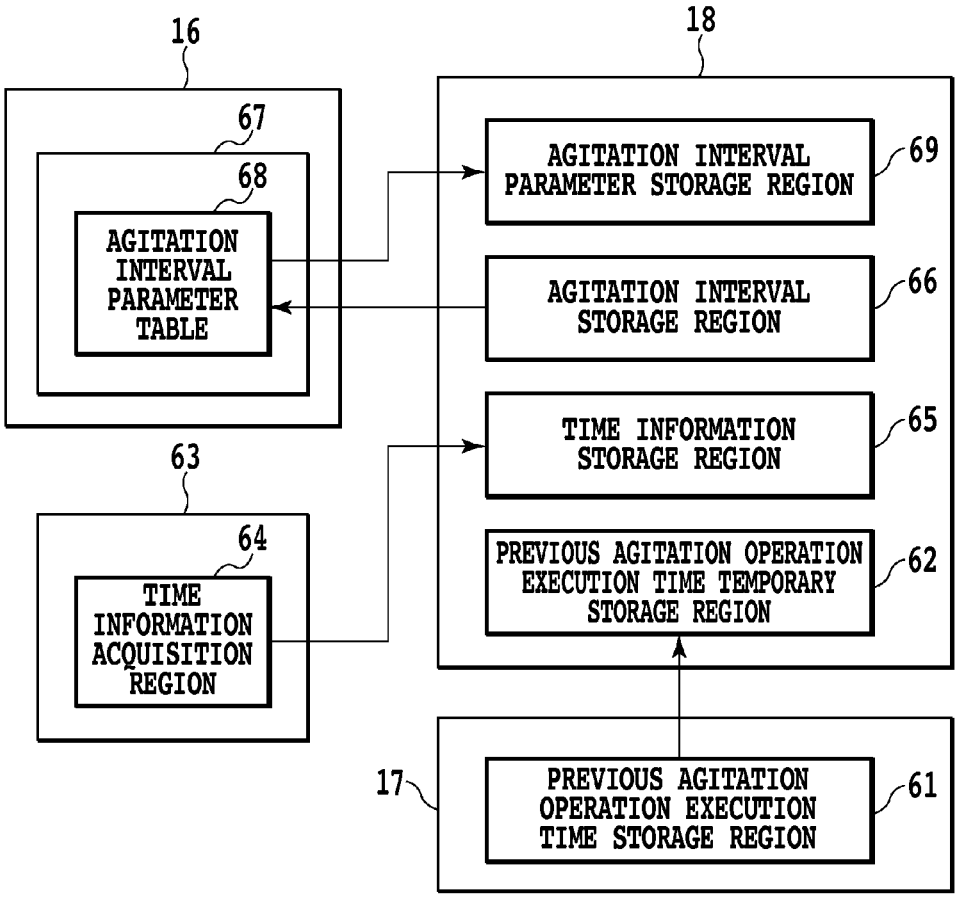
FIG. 10 is a block diagram showing the flows of data when an agitation interval parameter is calculated.

FIG. 10 shows the flows of data among the memories at the time of calculating an agitation interval parameter. First, the main control substrate 14 serving as a main controller accesses a previous agitation operation execution time storage region 61 to read out an execution time of the previous agitation operation stored on the nonvolatile memory 17. This execution time of the previous agitation operation is stored in a previous agitation operation execution time temporary storage region 62 in the volatile memory 18. Next, the main control substrate 14 accesses a time information acquisition region 64 to read out a current time from the time information of a timer IC 63 having a time measuring function, and stores the current time in a time information storage region 65 in the volatile memory 18. After an agitation interval is calculated by performing processing in which the previous agitation operation time is subtracted from the current time, the agitation interval is stored in an agitation interval storage region 66 in the volatile memory 18. The main control substrate 14 refers to an agitation interval parameter table 68 stored in a program ROM 67 stored in the nonvolatile memory 16 by using the calculated agitation interval, to read out an agitation interval parameter. The read agitation interval parameter is stored in an agitation interval parameter storage region 69 in the volatile memory 18.

An agitation operation can be instructed on an indicator (for example, an LED, a liquid crystal panel, a buzzer, a speaker, or the like) of the panel unit of the printing apparatus main body. Or, an agitation operation can be instructed by using a computer connected to the printing apparatus or software operated on a device such as a camera. When a user does not implement the instruction in response to an instruction of an agitation operation, printing may be prohibited. Or, this is merely a warning, and even if it is ignored, printing may be performed. When printing is performed after ignoring the instruction, the uniformity of the ink may be not secured by an agitation operation. However, the user may judge it with knowledge of the fact. In the present embodiment, the former case in which printing is prohibited is employed.

There is a variation in a progression rate of settling out of ink for each ink color. As an instruction to encourage a replacement of the tank or agitation outside the printing apparatus, only ink tanks needing agitation of not all colors are specified to instruct it in some cases. With regard to a rate of settling out of ink, a characteristic of each color is acquired in advance, and a rate can be judged on the basis of an amount of ink remaining and an elapsed time from a previous agitation operation.

Next, a judgment on an amount of ink remaining is made.

It is judged whether or not an amount of ink remaining is less than or equal to the saturation value SR (S204). The reason for this is that, when an amount of ink remaining is less than or equal to the saturation value SR, it is judged that it is difficult to recover the uniformity of ink concentration by an agitation operation only by a movement of the carriage 5. When an amount of ink remaining is made less than or equal to the saturation value SR, a situation is made in which a color material component among the ink components precipitates on the bottom of the ink tank, and there is a small amount of liquid component above the precipitated color material component. In this case, a warning about a replacement of the ink tank is given, or an instruction of agitation by another means is issued to the user (S212). Such a warning can be given on an indicator (for example, an LED, a liquid crystal panel, a buzzer, a speaker, or the like) of the panel unit of the printing apparatus main body. Or, an instruction can be issued through a computer connected to the printing apparatus or software operated on a device such as a camera. When a user does not implement the instruction in response to an instruction, printing may be prohibited. Or, this is merely a warning, and even if it is ignored, a printing operation may be performed. When an agitation operation is carried out in this state, although the uniformity of ink may not be secured by the agitation operation, the user may judge whether printing is possible or impossible with knowledge of the fact. When an amount of ink remaining is less than or equal to the saturation value SR, an agitation operation is not carried out, and the inkjet cartridge is replaced or ink concentration is recovered by another means other than an agitation operation. There is a variation in an effect of an agitation operation on an amount of ink remaining for each ink color. As an instruction to encourage replacement of the tank or agitation outside the printing apparatus, an instruction may be not issued with respect to the ink tanks of all colors simultaneously, but an instruction may be issued so as to specify an ink tank of each color in some cases.

Figure 11:
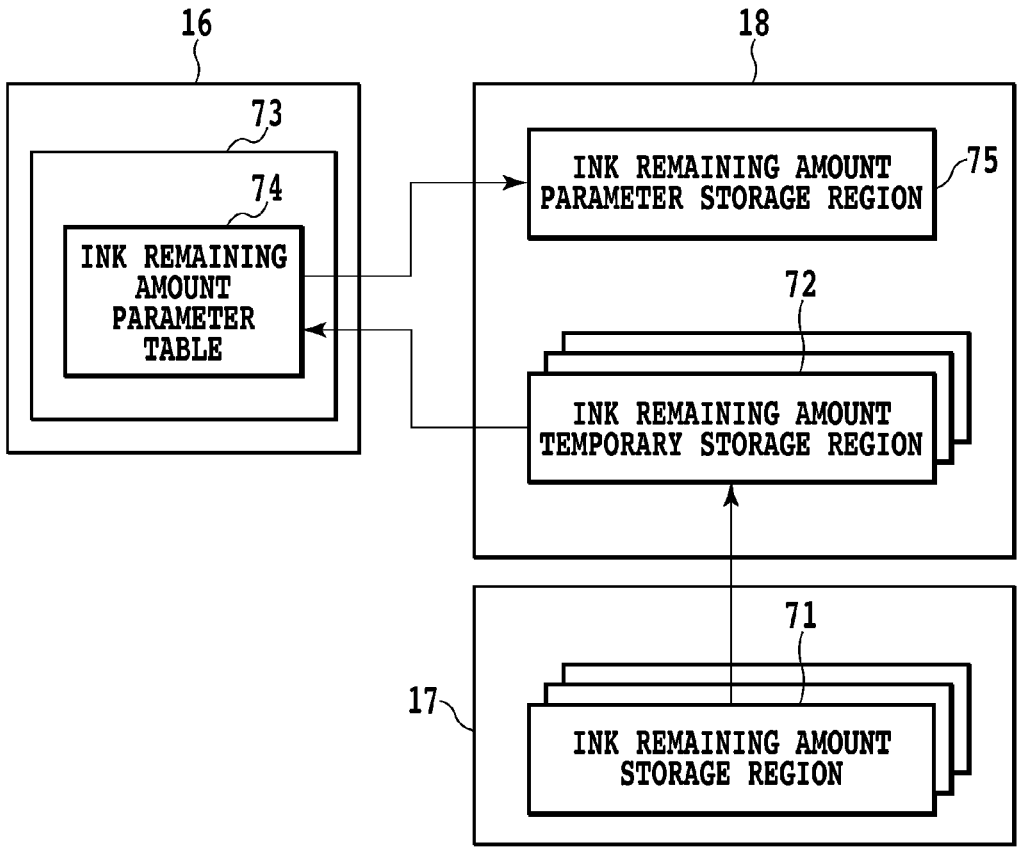
FIG. 11 is a block diagram showing the flows of data when an amount of ink remaining parameter is calculated.

When an amount of ink remaining is greater than the saturation value SR, an amount of ink remaining parameter is read out with reference to the amount of ink remaining parameter table stored in the program ROM on the basis of the amount of ink remaining. The read value is stored in a predetermined address in the volatile memory of the main control unit (S205). This amount of ink remaining parameter table is a table in which the relationship between the amount of ink remaining and the amount of ink remaining parameter shown in FIG. 5 is stored as a table in the program ROM. An effect of an agitation operation differs depending on an amount of ink remaining in the tank. An amount of ink remaining parameter is a parameter for converting an effect of an amount of ink remaining onto a level of agitation (agitation effect) in an agitation operation. FIG. 11 shows the flows of data among the memories 16, 17, and 18 at the time of calculating an amount of ink remaining parameter. First, amount of ink remainings of the respective colors stored in the nonvolatile memory 17 for storing setting values are read out from an amount of ink remaining storage region 71, and the amount of ink remainings are stored in an amount of ink remaining temporary storage region 72 in the volatile memory 18. Among the amount of ink remainings read the respective types of inks, an ink color of the smallest remaining amount is selected. An amount of ink remaining parameter is read out with reference to an amount of ink remaining parameter table 74 stored in a program ROM 73 in the nonvolatile memory 16 by using the amount of ink remaining of this color. The read amount of ink remaining parameter is stored in an amount of ink remaining parameter storage region 75 in the volatile memory 18. An amount of ink remaining parameter is read by the above-described processes.

In the present embodiment, an amount of ink remaining parameter is set on the basis of an amount of ink remaining reserved in the ink tank. The number of reciprocating motions of the carriage in an agitation operation is calculated by multiplying the number of reciprocating motions before taking into account an effect by an amount of ink remaining by an amount of ink remaining parameter.

Figure 12:
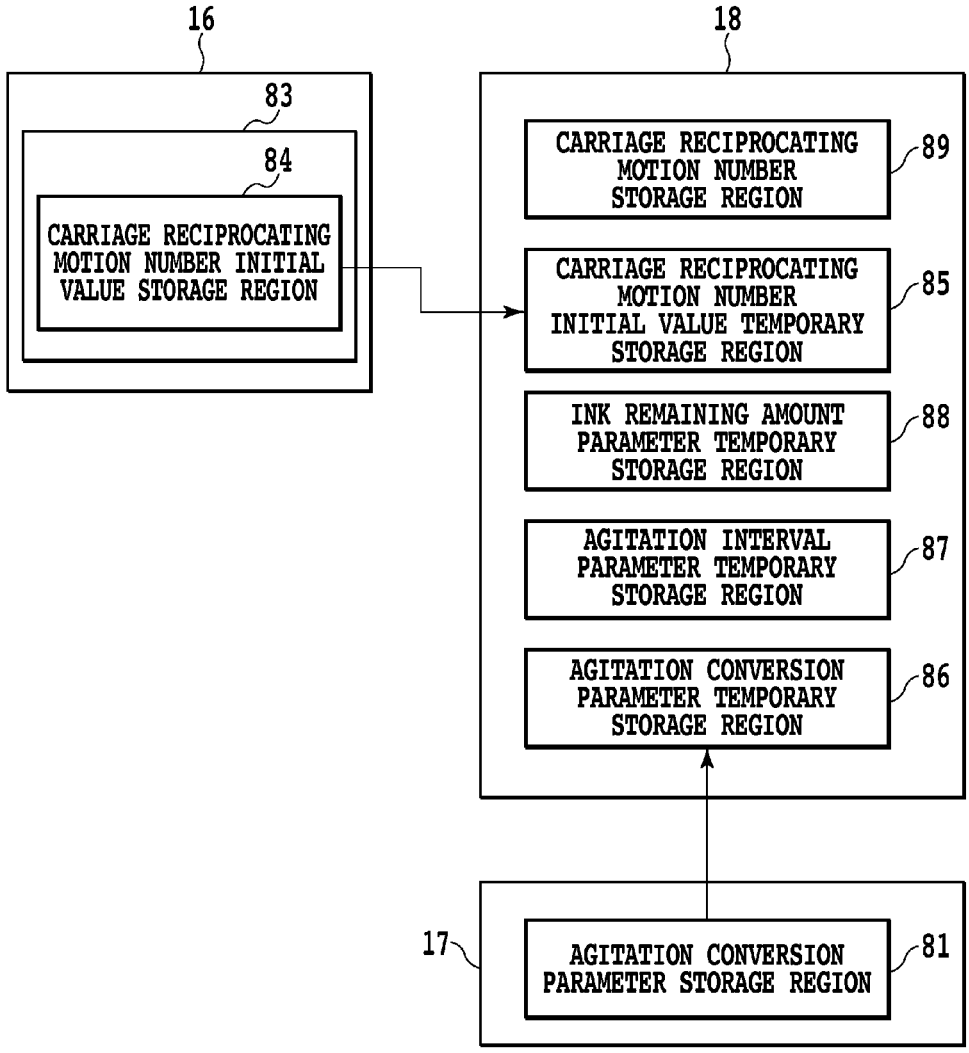
FIG. 12 is a block diagram showing the flows of data when a number of reciprocating motions of a carriage at the time of an agitation operation is calculated.

Next, the number of reciprocating motions of the carriage unit in an agitation operation is calculated (S206). FIG. 12 shows the flows of data at that time. First, the main control substrate 14 reads out an agitation conversion parameter stored in an agitation conversion parameter storage region 81 in the nonvolatile memory 17, and stores it in an agitation conversion parameter temporary storage region 86 in the volatile memory 18. The nonvolatile memory 17 is a memory for storing settings. A carriage reciprocating motion number initial value storage region 84 is provided in the program ROM 83 in the nonvolatile memory 16. An initial value of the number of reciprocating motions of the carriage 5 in an agitation operation is stored in the carriage reciprocating motion number initial value storage region 84 in advance. This initial value is read out to be stored in a carriage reciprocating motion number initial value temporary storage region 85 in the volatile memory 18. By using an initial value of the number of reciprocating motions of the carriage 5 in an agitation operation, an integrated agitation conversion parameter, and the agitation interval parameter and the amount of ink remaining parameter which are calculated previously, the number of reciprocating motions of the carriage in an agitation operation to be performed from now is calculated. The integrated agitation conversion parameter is stored in an integrated agitation conversion parameter temporary storage region 86. The agitation interval parameter calculated previously is stored in an agitation interval parameter temporary storage region 87. The amount of ink remaining parameter is stored in an amount of ink remaining parameter temporary storage region 88. The number of reciprocating motions of the carriage 5 is updated by storing the calculated number of reciprocating motions of the carriage in the carriage reciprocating motion number initial value temporary storage region 85 again. In the present embodiment, the ASIC 15 serving as a reciprocating motion number setting means in the main control substrate 14 calculates the number of reciprocating motions of the carriage 5 to set it.

As a calculation formula at the time of a calculation, the formula of FIG. 13 is used in the present embodiment. The number of reciprocating motions Y of the carriage in an agitation operation in the present embodiment is calculated by the following calculation. The calculation is performed such that a value of an agitation conversion parameter Σan in which various types of printing information are integrated is subtracted from an initial value Y0 of the number of reciprocating motions in agitation without taking into account various types of printing information such as a printing mode, and a speed and an accelerated velocity of the carriage, and the like, and that value is multiplied by an amount of ink remaining parameter b and an agitation interval parameter c. An agitation effect in a reciprocating motion of the carriage at the time of an agitation sequence regulated in advance, and an agitation effect by a reciprocating motion of the carriage in a printing operation performed between a previous agitation operation and a current agitation operation are taken into account. After taking into account these two types of agitation effects, the number of reciprocating motions in an agitation operation to be carried out in the present embodiment is calculated. Moreover, by respectively weighting relevant respective factors such as an amount of ink remaining, an agitation interval, and a color type, the number of reciprocating motions in an agitation operation is calculated in view of these factors. This arithmetic formula varies depending on methods for setting various types of parameters. A result of this formula does not come to an integer number depending on methods for setting parameters, and the result is preferably rounded up in that case. A case in which agitation more than the necessary agitation is carried out is more reliable than a case in which only agitation less than the necessary agitation is carried out in order to retain the uniformity of ink concentration. Such a method of setting the number of the agitation has more leeway. The rounded up calculated result is stored in a carriage reciprocating motion number storage region 89 in the volatile memory 18. With the above descriptions, the number of reciprocating motions of the carriage in an agitation operation to be performed from now is calculated.

Next, it is judged whether or not the number of reciprocating motions in an agitation operation can have an effective value (S207). This process is executed because it is assumed that, in a calculation of the number of reciprocating motions of the print head, the current number of reciprocating motions of the print head becomes a negative number because the number of reciprocating motions in a typical printing operation is large. This case corresponds to a case in which it is judged that an agitation operation is unnecessary, and the routine does not proceed to an agitation operation, but shifts to reset parameters and the timer (S210). Resetting of parameters is to reset the integrated agitation conversion parameter, to renew the stored previous agitation time to a current time, and to reset the agitation timer in detail. Note that, when the number of agitating times is an effective value, i.e., the number of agitating times is one or more, an agitation operation is carried out (S208). The control parameters of the carriage at this time, i.e., a speed in a constant speed range, an accelerated velocity, and an acceleration distance are stored in advance in the program ROM. There may be a plurality of control parameters. However, one control parameter is used in the present embodiment. The carriage is moved by a calculated number of reciprocating motions by a determined control method (carriage speed), which carries out agitation of the ink tank. In an agitation operation according to the present invention, the number of agitating times is determined in view of an agitation effect by the reciprocating motions of the print head carried out in printing. However, the number of reciprocating motions of the carriage is not necessarily decreased. The reason for this is that the number of reciprocating motions is calculated by using a progressing situation of settling out, an amount of ink remaining parameter, and an agitation interval parameter. In a case in which an amount of ink remaining is greater than or equal to the saturation value SR and less than or equal to the specified value LR, a case in which an agitation interval is greater than or equal to the specified value LT and less than or equal to the saturation value ST, or a case in which an ink color having a low agitation effect is included, these parameters are set to one or more. When the parameter is biased to a direction in which the number of reciprocating motions is increased, there is a possibility that the number of reciprocating motions of the carriage unit in an agitation operation is made greater than an initial value set in advance. The reason for this is that the number of reciprocating motions is calculated, not only focusing on the reciprocating motion of the carriage, but also in view of factors such as an agitation interval, an amount of ink remaining, and a color connected with the settling out characteristic and configuration of the ink. Such a case apparently seems to have no effect on shortening an agitation time exemplified as a problem. However, such an agitation operation is carried out on the basis of the judgment as a necessary agitation operation. Because a necessary agitation operation is carried out as compared with a conventional case in which an agitation operation is carried out according to a determined number of times, the uniformity of ink concentration in the ink tank 7 is retained, and the quality of ink is preserved longer. Additionally, because a user frequently using the printing apparatus frequently performs printing operations, a time per recovery operation tends to be shortened, and the printing apparatus 1 can be used comfortably without waiting for a long time. On the other hand, with respect to a less frequently used printing apparatus, it is possible to increase the number of agitating times, encourage replacement of the ink tank, or encourage agitation by means other than the printer. The convenience may be improved as long as the stability in ink concentration when the user is using the printing apparatus is retained.

When the agitation operation is completed (S209), the routine shifts to reset parameters and the timer (S210). At last, the agitation timer is started up to start a time measurement to the following agitation operation (S211), and the agitation operation is completed.

In accordance with the printing apparatus 1 of the present invention, because there is no need to carry out an agitation operation for an unnecessarily long time, it is possible to efficiently obtain a printed matter by the printing apparatus 1. Further, because a necessary amount of agitation operation is carried out, it is possible to shorten the time during the agitation operation with the uniformity of ink concentration by agitation maintained. In this way, provided that only a necessary amount of agitation operation is carried out, which shortens the time during the agitation operation when printing cannot be performed, there is no need to set an unnecessarily long waiting time for the user.

Note that, in the present embodiment, the number of reciprocating motions of the print head 6 in an agitation operation is set by using conditions for the time when the print head 6 moves and various types of parameters such as an amount of ink remaining and a time interval between agitation operations. However, an agitation time may be set in place of the number of reciprocating motions. A length of an agitation time for which the print head is made to reciprocate as an agitation operation may be set according to conditions for printing. Provided that an agitation level to be agitated is adjusted in this way, a necessary agitation operation is carried out while a waiting time for a user during the agitation operation is shortened. At that time, the ASIC 15 serving as an agitation time setting means on the main control substrate 14 may calculate to set an agitation time for which the carriage 5 reciprocates.

In the present embodiment, the number of reciprocating motions of the carriage in an agitation operation is set in view of an agitation effect by a movement of the carriage in a printing operation. However, a method for setting a specified value of the agitation timer to judge whether or not an agitation operation is required may be used. A time interval from a previous agitation operation until it is judged that a next agitation operation is required may be set. With this, the timing in which an agitation operation is started in the printing apparatus is adjusted with respect to an initial setting, and a necessary agitation operation is carried out while awaiting time for the user during the agitation operation is shortened. At this time, the ASIC 15 serving as an agitation interval time setting means on the main control substrate 14 may calculate to set an agitation interval time.

In the present embodiment, an agitation operation may not be a reciprocating motion of the carriage, but an operation of repeating acceleration, deceleration, and stopping in one direction several times. The print head achieves a predetermined number of movements in one direction, which carries out an agitation operation. In this case, a cycle from start to stop of the movement of the print head may be counted as one movement.

In the present embodiment, the ink has been described. However, any liquid which is contained in a liquid container, and includes a particulate component settling out and liquid as a solvent therefore, and whose particulate component settles out in the liquid container due to the elapse of time, which is not necessarily ink, may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-245367, filed Sep. 21, 2007, which is hereby incorporated by reference herein in its entirety. of the print head in printing.

What is claimed is:

1. An inkjet printing apparatus comprising:

a carriage capable of mounting a liquid container;

a control unit that carries out control for executing an agitation operation for agitating the liquid retained in the liquid container by reciprocating the carriage; and an agitation mode setting unit that sets an agitation condition for the agitation operation executed under control of the control unit, wherein the agitation mode setting unit sets the agitation condition for the agitation operation by the carriage in accordance with a printing mode for printing to a printing medium.

2. The inkjet printing apparatus according to claim 1, wherein the agitation mode setting unit determines an agitation conversion parameter according to speed conditions including at least an accelerated velocity in an acceleration state from a stopped state into a constant speed state, a speed in a constant speed state, and a deceleration velocity in a deceleration state from a constant speed state into a stopped state of the printing part, and distances at which the carriage moves in the respective states, determined on the basis of the printing mode, and the agitation mode setting unit sets the agitation condition for the agitation operation on the basis of the agitation conversion parameter.

3. The inkjet printing apparatus according to claim 2, wherein the agitation mode setting unit sets the agitation condition for the agitation operation on the basis of, in addition to the agitation conversion parameter, a liquid remaining amount parameter on an amount of liquid contained in the liquid container, an agitation interval parameter on a time interval among a plurality of agitation operations, or both of the parameters.

4. The inkjet printing apparatus according to claim 3, wherein the agitation interval parameter is a parameter on a specified value or a saturation value of an agitation interval among the plurality of agitation operations, when the agitation interval is less than or equal to the specified value, it is judged as a state in which the agitation interval is short and a concentration difference in the liquid in the liquid container is small, and the agitation operation is not carried out, and when the agitation interval is greater than or equal to the saturation value, it is judged that the agitation interval is long and a concentration difference in the liquid in the liquid container is large, and no further agitation operation is necessary, and the agitation operation is not carried out.

5. The inkjet printing apparatus according to claim 4, wherein when the agitation operation is not carried out, an agitation method other than the agitation operation is encouraged or a warning is indicated.

6. The inkjet printing apparatus according to claim 1, wherein the agitation condition is a number of movements, a moving speed, or a moving distance of the carriage in the agitation operation other than that in printing.

7. An inkjet printing apparatus comprising:

a carriage capable of mounting a liquid container;

a control unit that carries out control for executing an agitation operation for agitating the liquid retained in the liquid container by reciprocating the carriage; and an agitation mode setting unit that sets an agitation condition for reciprocating the carriage in the agitation operation under control of the control unit, wherein the agitation mode setting unit sets the agitation condition for reciprocating the carriage that carries out the agitation operation in accordance with a predetermined agitation operation and a printing condition.

8. The inkjet printing apparatus according to claim 7, wherein, given that $Y_0$ is an initial value of a number of reciprocating motions in an agitation operation, a is an agitation conversion parameter determined on the basis of printing mode for printing to the printing medium by the printing part and including at least an accelerated velocity from a stopped state into a constant speed state, a speed in a constant speed state, a deceleration velocity up to a stopped state, and distances at the respective speeds of the printing part, n is a number of scanning movements in a scanning direction of the carriage carried out in printing onto the printing medium in the printing part, b is a liquid remaining amount parameter on an amount of liquid contained in the liquid container, and c is an agitation interval parameter on a time interval among a plurality of agitation operations, a number of reciprocating motions Y of the carriage in the agitation operation is calculated by formula;

$$Y=(Y_0-\Sigma an)\cdot b\cdot c$$

to set as the method for moving the carriage in the agitation operation.

9. A method for agitating ink in an inkjet printing apparatus which includes a carriage capable of mounting an ink tank containing ink thereon, the printing apparatus configured to perform printing onto a printing medium by ejecting ink supplied from the ink tank to an ink ejecting part in accordance with a reciprocating motion of the carriage, wherein the inkjet printing apparatus includes a control unit that carries out control for executing an agitation operation for agitating ink retained in the ink tank by moving the carriage, and an agitation mode setting unit that sets an agitation condition for the agitation operation, the method comprising:

a step of reading an agitation conversion parameter on a printing mode by the ejecting part;

a step of setting the agitation condition for the agitation operation by the carriage in view of the printing mode; and a step of calculating a number of scanning movements of the carriage by the agitation operation on the basis of the respective parameters from an initial value of the number of reciprocating motions of the carriage in the agitation operation according to an amount of ink remaining parameter on an amount of ink contained in the ink tank and an agitation interval parameter on a time interval among a plurality of agitation operations.

10. The method according to claim 9, wherein the agitation conversion parameter determined on the basis of the printing mode is a parameter corresponding to speed conditions including at least an accelerated velocity in an acceleration state from a stopped state into a constant speed state, a speed in a constant speed state, and a deceleration velocity in a deceleration state from a constant speed state into a stopped state of the printing part, and respective distances at which the carriage moves in the respective states, the agitation interval parameter is a parameter on a specified value or a saturation value of an agitation interval which is a time interval between agitation operations when the plurality of agitation operations are carried out, and the step of setting the agitation condition for the agitation operation includes:

a step of judging whether the agitation interval is short and a concentration difference in the liquid in the liquid container is small when the agitation interval is less than or equal to the specified value, and a step of judging whether the agitation interval is long and a concentration difference in the liquid in the liquid container is large, and no more agitation operation is necessary when the agitation interval is greater than or equal to the saturation value, and the agitation operation is not carried out when the agitation interval is less than or equal to the specified value, or greater than or equal to the saturation value.

* * * * *